United States Patent [19]

Matsuo et al.

[11] 4,328,267

[45] May 4, 1982

[54] PROCESS FOR PRODUCING A COATING OF UNIFORM THICKNESS OF AN ELEMENT

[75] Inventors: Takehiko Matsuo, Kawasaki; Ken Masuda, Yokohama, both of Japan

[73] Assignee: Canon Kabushiki Kaisha, Tokyo, Japan

[21] Appl. No.: 90,653

[22] Filed: Nov. 2, 1979

Related U.S. Application Data

[63] Continuation of Ser. No. 892,923, Apr. 3, 1978, abandoned, which is a continuation of Ser. No. 678,034, Apr. 19, 1976, abandoned.

[30] Foreign Application Priority Data

Apr. 25, 1975 [JP] Japan ..... 50/50287

[51] Int. Cl.[3] ..... B05D 1/40; B05D 3/12; B05D 1/18

[52] U.S. Cl. ..... 427/345; 427/445; 427/430.1

[58] Field of Search ..... 427/430.1, 435, 345, 427/445; 118/DIG. 11, 404, 405, 407

[56] References Cited

U.S. PATENT DOCUMENTS

| | | | |
|---|---|---|---|
| 2,808,344 | 10/1957 | Kaulen et al. | 427/435 |
| 3,046,156 | 7/1962 | Kaulen | 427/430.1 |
| 3,117,028 | 1/1964 | Kaulen | 118/404 |
| 3,209,723 | 10/1965 | Schrodersecker | 118/404 |

*Primary Examiner*—S. L. Childs

*Attorney, Agent, or Firm*—Fitzpatrick, Cella, Harper & Scinto

[57] ABSTRACT

A member to be coated is placed in a hollow portion of an external member and a coating material is charged in a gap between the member to be coated and the external member. The member to be coated has another member fixed thereto. The member to be coated is drawn from the hollow portion of the external member to form a coated film thereon.

11 Claims, 10 Drawing Figures

PROCESS FOR PRODUCING A COATING OF UNIFORM THICKNESS OF AN ELEMENT

This is a continuation, of application Ser. No. 892,923, filed Apr. 3, 1978 which in turn is a continuation application of Ser. No. 678,034, filed Apr. 19, 1976, both now abandoned.

BACKGROUND OF THE INVENTION

1. Field of the Invention

This invention relates to a process for coating and an apparatus therefor, and more particularly to a process for coating to produce a coated film of a uniform thickness and uniform property, and an apparatus therefor.

2. Description of the Prior Art

Heretofore, there have been known various processes for forming coated films such as by using a brush, by spraying, and by dipping in a liquid coating material and the like. However, in these processes it is essential to use a technic of a higher level for the purpose of producing a coated film of a highly uniform thickness and in particular, it is very difficult to produce a very thin film of a uniform thickness. For example, when a member to be coated is dipped in a vessel containing a coating material and then pulled out to form a coated film on the surface of the member to be coated, the composition of the coating material and its concentration distribution in the coating material should be kept always constant to produce a coated film of a uniform thickness. Contamination of external impurities also should be avoided. It addition, unevenness of thickness of the coated film, which is caused by nonuniform flowing-down of the coating material applied to a member to be coated, should be prevented. Therefore, an elaborate and high-level technic is required to take care of the above mentioned conditions and thereby the coating procedure becomes very complicated.

SUMMARY OF THE INVENTION

An object of the present invention is to provide a process for coating to produce a thin coated film of a uniform thickness with ease.

Another object of the present invention is to provide a process for producing a thin coated film of a uniform thickness efficiently and automatically.

A further object of the present invention is to provide a process for coating where the coated film is not contaminated with any impurities.

Still another object of the present invention is to provide an apparatus for carrying out the above mentioned processes.

According to one aspect of the present invention, there is provided a process for coating which comprises removing a member to be coated from a hollow portion of an external member into which it has been placed by relatively moving these members, a coating material being present in a gap between at least the member to be coated and the external member, an internal member being fixed to the member to be coated at a portion at which a coating material is not to be applied and which is the rear portion when the member to be coated is moved for removal from the external member.

According to another aspect of the present invention, there is provided an apparatus for coating such comprises:

(1) a hollow external member, (2) a member to be coated, (3) an internal member fixed to a member to be coated, (4) a means for moving the internal member and the member to be coated in the hollow external member, and (5) a member for preventing the coating material from leaking out of the gap between the hollow external member and the member to be coated having an internal member fixed thereto, the gap being provided for receiving a coating material, the member to be coated having the internal member fixed thereto being arranged so as to pass inside of the hollow external member.

DESCRIPTION OF THE PREFERRED EMBODIMENTS

According to the present invention, the coating material is placed in a gap defined by the hollow external member, the member to be coated and the internal member fixed to the member to be coated and thereby the liquid surface area of the coating material can be relatively small so that the coating material is hardly contaminated by impurities. Further, the small liquid surface area serves to suppress the change of coating material composition caused by evaporation. In addition, the speed of removing the member to be coated from the coating material can be precisely controlled because the member to be coated integrated with an internal member and the hollow external member may be relatively moved, and the member to be coated can be stably retained. Therefore, a uniform coated film of a uniform thickness can be easily formed on the member to be coated.

The process of the present invention may be understood by referring to FIG. 1*a*–FIG. 1*d*. Now referring to FIG. 1*a*, internal member 2 is placed in a hollow portion of external member 1 and a coating material 3 composed of, for example, photoconductor particles dispersed in a solution of a binder resin is charged in a gap defined by internal member 2, external member 1 and a means 4 for preventing the coating material 3 from leaking.

Figure 1A:
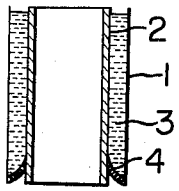
FIG. 1*a*–FIG. 1*d* show an embodiment of a process for coating according to the present invention.
Figure 1B:
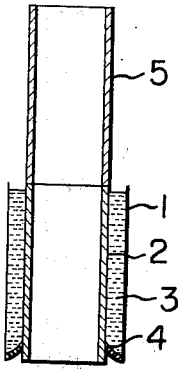
Figure 1C:
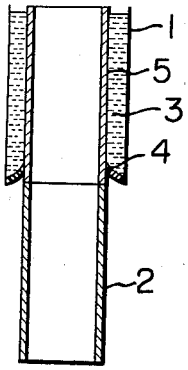

Referring to FIG. 1*b*, a member 5 to be coated is mounted on internal member 2. Referring to FIG. 1*c*, internal member 2 or external member 1 or both of them are moved to place a member to be coated in external member 1. The means 4 for preventing leakage not only prevents the coating material 3 from leaking, but prevents the outer surface of internal member 2 from being coated with the coating material 3.

Figure 1D:
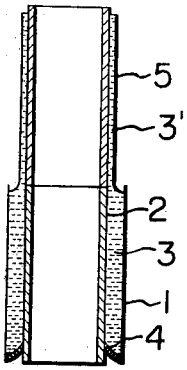

Referring to FIG. 1*d*, external member 1 or internal member 2 or both of them are moved to draw out member 5 to be coated to form a coated film 3' of a uniform thickness on it.

The member 5 to be coated as shown in FIG. 1*b*–FIG. 1*d* may be a hollow cylinder, that is, a drum, but may be in other forms, such as, plate, square pillar and the like. When the lower end surface of the member 5 to be coated should be prevented from being attached by the coating material, it is effective to closely contact the intersurface between internal member 2 and the member 5 to be coated so as to prevent the coating material from penetrating into the intersurface.

As shown in FIG. 1*c*, when internal member 2 is pulled down and comes outside external member 1, member 4 for preventing leakage can prevent coating material 3 from leaking along the surface of internal member 2.

It is preferable to maintain a distance between the top portion of external member 1 and the liquid surface of coating material 3. This may be attained by selecting the size and shape of internal member Z in such a way that the size of the gap between the internal member 2 and the hollow external member 1 is the same as that between member 5 to be coated and the hollow external member 1.

In general, it is preferable that the cross sectional areas and shapes of the member to be coated and the internal member, perpendicular to the direction in which the member to be coated moves, are substantially the same and in addition, it is preferable that the cross sectional area and shape of the hollow portion of the hollow external member are uniform along the direction in which the member to be coated moves.

Therefore, when the member to be coated is a cylindrical member, it is preferable that the internal member is a cylindrical member having substantially the same diameter as the member to be coated.

According to the present invention, the coated film forming process may be started from FIG. 1*a*, FIG. 1*b* or FIG. 1*c*.

Figure 2:
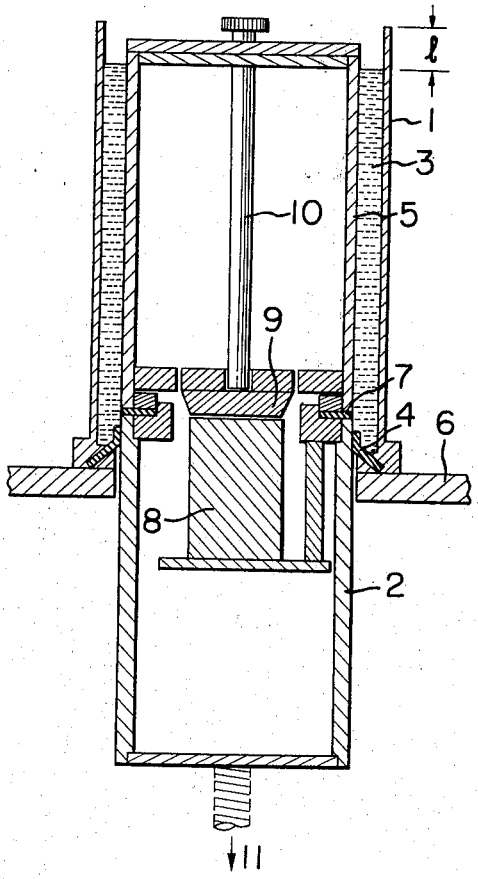
FIG. 2 is a vertical section of an embodiment of an apparatus according to the present invention.

Referring to FIG. 2, external member 1 is mounted on table 6, and internal member 2 is movable vertically, as viewed, through a hole in table 6. A means 4 for preventing a coating material from leaking is provided on table 6. Internal member 2 is formed in such a way that it does not pass through out of said member 4. The size of table 6 and shapes of internal member 2 and external member 1 may vary depending upon the shape of a member 5 to be coated. A means 7 for closely contacting, e.g. seal, is arranged between internal member 2 and member 5 to be coated, and can prevent the coating material from penetrating into the inside of the member 5 to be coated.

The coating material 3 is placed in a gap defined by external member 1, internal member 2, and member 5 to be coated.

As shown in FIG. 1*a*, internal member 2 is placed in external member 1 by pulling internal member 2 up to the same height as external member 1, and then a coating material 3 is charged in the gap. Then, a member 5 to be coated is mounted on internal member 2. It is preferable that internal member 2 and the member to be coated are closely connected without any interstice therebetween. To closely connect these members FIG. 2 shows a method of using a magnet. Inside of internal member 2 is provided a magnetic means such as electromagnetic device 8, and there is provided a member 5 to be coated supported by supporting rod 10 having attracting piece 9. When electromagnetic device 8 and attracting piece 9 are placed face to face, they are closely connected through a means 7 such as a seal for closely contacting same by magnetic attracting force. When internal member 2 and a member 5 to be coated can be closely connected without a means 7 for closely connecting them, said means may be omitted. The magnet may be a permanent magnet. Internal member 2 is then pulled down to the direction of arrow 11 to the position as shown in FIG. 1*c* and member 5 to be coated and internal member 2 are pulled up to the position of FIG. 1*d*.

For the purpose of obtaining a satisfactory coated film of a uniform thickness on the member to be coated, it is desirable to control the conditions for drying the coating material coated on the member to be coated. In particular, a rapid drying should be avoided.

As shown in FIG. 2, the liquid surface of the coating material 3 is always contacted with air. This contact with air usually accelerates evaporation of a solvent in the coating material and drying of the coating material. For example, when member 5 to be coated is pulled up as shown in FIG. 1*d*, coated film 3' is obtained by drying the coating material. If the coating material is rapidly dried by contacting air abruptly, the coated material is solidified rapidly and there is no time for the coated material thus coated to flow down to form a uniform film having a uniform thickness. As the result, there is formed a coated film of uneven thickness. In order to prevent the formation of uneven thickness, the removing of the member to be coated from the coating material is effected preferably at a low and constant speed, for example, not faster than 20 cm/min., particularly not faster than 10 cm./min. For the purpose of keeping the removing speed substantially constant, it is desirable that the height of liquid surface of the coating material is maintained constant as far as possible. For example, the distance between the liquid surface of the coating material 3 and the top of external member 1 (designated as "l") as shown in FIG. 2 is kept constant as far as possible.

Figure 3:
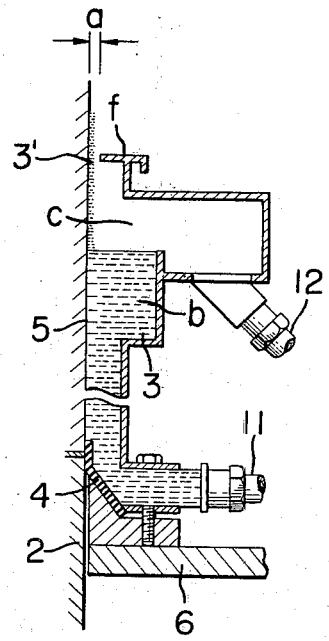
FIG. 3 shows a vertical section of a part of an embodiment of an apparatus of the present invention.

For the purpose of preventing a rapid drying of the coating material, the coating material is gradually brought into contact with air, for example, as shown in FIG. 3. There is shown a coating material containing portion "b" outside of a member 5 to be coated. A coating material 3 is charged in said portion "b" which has a vapor room "c." The vapor room "c" is for retaining a vapor of the coating material, and the vapor concentration at the exit opening is low and increases towards the liquid surface of the coating material. When member 5 to be coated is pulled out from the coating material 3, that member 5 to be coated thus is exposed to a vapor of a high concentration and then gradually to a vapor of a low concentration in the vapor room "c." This procedure is an effective method for obtaining a coated film of a uniform property and thickness. Further, it is also effective to control the gap "a" at the exit opening for the vapor room by using a lid "f." This gap "a" contributes to controlling the concentration of vapor in the vapor room. The value "a" is determined depending upon thickness of the coated film, viscosity of the coating material, volatility of a liquid medium of the coating material, removing speed and others. Drain cocks 11 and 12 are provided for supplementing or exchanging the coating material. For example, a coating material is supplied from drain cock 11 continuously or intermittently and overflown through drain cock 12, and this procedure is useful for maintaining the composition of the coating material constant. Further, it is possible to place a means for filtering between the inlet and the exit for the coating material so as to remove dust or other undesirable matters and facilitate an effective circulation.

Figure 4:
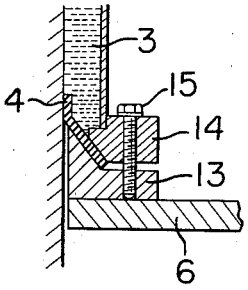
FIG. 4 is a vertical section of a part of an embodiment of an apparatus of the present invention.

In FIG. 3, a member 4 for preventing leakage directly contacts the liquid coating material at the lower portion of the surface. There is a fear that such a way of contact causes a deformation of the member 4 for preventing leakage due to a liquid pressure and the leak preventing effect is degraded. In such a case, it is effective as shown in FIG. 4 that the member 4 for preventing leakage be mounted on supporting member 13 and pressed with a pressing member 4 by tightening with a bolt 15.

The means for preventing leakage may be of the same material as that of the means 7 for effecting close contact. For example, synthetic resin seals may be used. In addition, other materials may be used which are not adversely affected by or do not adversely affect the coating material and cause neither physical nor chemical change during the coating procedure. In particular, physical durability such as durability against temperature, pressure and the like, is necessary.

Figure 5:
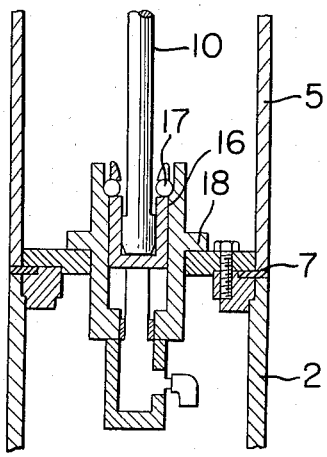
FIG. 5 and FIG. 6 show vertical sections of a part of an embodiment of an apparatus according to the present invention for illustrating how to connect the two members.
Figure 6:
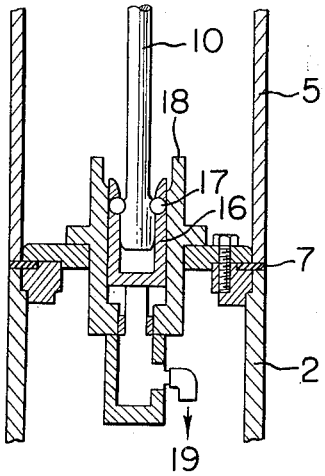

FIG. 5 and FIG. 6 show another way of connecting internal member 2 with a member 5 to be coated and a vacuum is utilized. FIG. 5 and FIG. 6 correspond to a state before connecting and that after connecting, respectively.

In FIG. 5, a member 5 to be coated is mounted on internal member 2, and supporting rod 10 of a member 5 to be coated fits into connecting member 16 provided in internal member 2. Connecting member 16 has bearings 17 at the upper portion thereof and is provided in housing 18. After fitting, air in housing 18 is sucked by a vacuum pump in a direction of arrow 19 as shown in FIG. 6 and connecting member 16 is attracted downward. Thus, bearings 17 in connecting member 16 are fitted to indent portions of supporting rod 10 and fixed, and internal member 2 and a member 5 to be coated are closely connected through a means 7 for effecting close contact.

Figure 7:
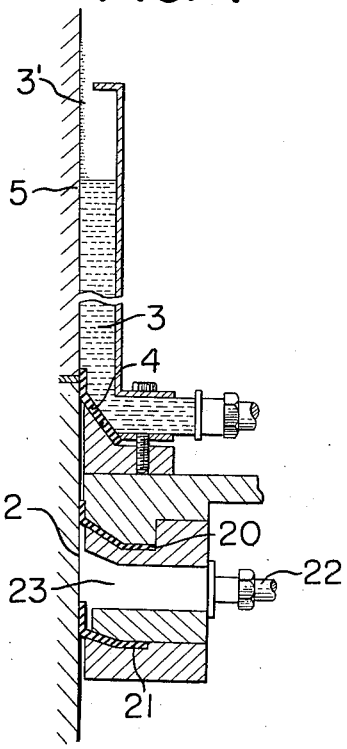
FIG. 7 is a vertical section of a part of an embodiment of an apparatus according to the present invention to show a cleaning device.

According to another embodiment of the present invention, a surface of the internal member which is not contacting the coating material is washed during the formation of the coated film. Referring now to FIG. 1*c*, the surface of internal member 2 is outside of the coating material containing portion. The coating material hardly attaches to the surface of the internal member due to the function of a means 4 for preventing leakage but if the leak preventing action does not work sufficiently, some coating material adhere to the surface of the internal member. In such a case, the coating material adhering to the surface of the internal member damages the means for preventing leakage or when such adhered dried coating material is brought into the coating material containing portion again, the dried matter is dispersed in the coating material as a kind of impurity. For the purpose of solving such problems, an apparatus as shown in FIG. 7 may be used, and through drain cock 22 a washing liquid is charged, and internal member 2 is washed while passing the portion 23 for receiving a washing liquid between leakage preventing members 20 and 21. As the washing liquid, thereby may be employed a liquid capable of dissolving or peeling the coating material. The washing liquid is taken out through an exit (not shown). The washing liquid may be recirculated.

The resulting thickness of the coated film on the member to be coated is dependent upon the conditions under which the member to be coated is removed from the coating material in the external member. In particular, the resulting thickness of the coated film is affected by viscosity of the coating material and the removing speed of the member to be coated.

For example, in case of producing a photosensitive member for electrophotography, 100 parts by weight of cadmium sulfide and 10 parts by weight of a vinyl chloride-vinyl acetate copolymer are mixed with methyl ethyl ketone to produce a coating material having a viscosity of 600–1000 cps. and the resulting coating material is applied to a member to be coated according to the present invention. In order to obtain a thickness of the coated film of 30–60 microns, the speed for pulling up the member to be coated is 2–6 cm./min. When the viscosity is 750 cps. and the resulting coated film thickness is 45 microns, the pulling up speed is about 3 cm./min.

In another example, a urethane resin is dissolved in methyl ethyl ketone to form a coating material and then coated on a support to produce an insulating layer, and when the viscosity is 50–150 cps., a thickness of a coated film of 10–20 microns as an insulating layer is obtained by pulling out at a speed of 2–6 cm./min. For example, a thickness of a coated film of an insulating layer of 12 microns can be obtained when the viscosity is 90 cps. and the pulling-out speed is 3 cm./min. In such a way, a coated film of uniform properties and a uniform thickness can be obtained.

The present invention is particularly suitable for producing a coated film such as that having a thickness ranging from 0.1–300 microns. For the purpose of producing such a thin thickness, the gap between the external member and the member to be coated is preferably not more than 30 mm, more preferably, 3–30 mm.

The feature of the present invention is that the coated film is not contaminated with dust or other impurities because the coating material in the gap is hardly contacted directly with air, and loss of the coating material is almost none because the coating material is applied to only the necessary portion of the member to be coated. Further, the present invention is suitable for a mass production of coated films and can easily control the thickness of the coated film.

The present invention can be used for producing a photoconductive layer or an insulating layer of an electrophotographic photosensitive member having a uniform thickness with accuracy and a uniform composition. Further, when the support member of the photosensitive member is of a type of drum, there can be obtained a seamless photosensitive member, and a photosensitive member having an insulating layer can be produced with ease in a way similar to producing a photoconductive layer.

What is claimed is:

1. A process for applying a thin uniform coating to a member to be coated, which comprises:

positioning a member to be coated in a hollow portion of an external member, fixing an internal member to the member to be coated at a portion thereof where a coating material is not to be applied and which is the rear portion thereof when the member to be coated is moved from the external member, removing the member to be coated from the hollow portion of said external member by relatively moving these members while a coating material is present in a gap between at least the member to be coated and the external member, applying leakage preventing means which is fixed in respect of the external member in sliding contact with the surface of the internal member so as to prevent the coating material from leaking along the surface of the internal member, and as the member to be coated is removed from the coating material, causing the coating material accumulated in the gap between the surface of the member to be coated and the inner surface of the external member to be accumulated in the gap between the outer surface of the internal member and the inner surface of the external member, wherein said gap exists throughout said relative movement.

2. A process for applying a thin uniform coating to a member to be coated, which comprises: positioning a member to be coated in a hollow portion of an external member, fixing an internal member to the member to be coated at a portion thereof where a coating material is not to be applied and which is the rear portion thereof when the member to be coated is moved from the external member, removing the member to be coated from the hollow portion of said external member by relatively moving these members while a coating material is present in a gap between at least the member to be coated and the external member, the coating material being circulated to and from said gap while the member to be coated is being removed, and as the member to be coated is removed from the coating material the internal member is moved to take the place of the member to be coated as same is withdrawn, and applying leakage preventing means which is fixed in respect of the external member in sliding contact with the surface of the internal member so as to prevent the coating material from leaking along the surface of the internal member, and, as the member to be coated is removed from the coating material, causing the coating material accumulated in the gap between the surface of the member to be coated and the inner surface of the external member to be accumulated in the gap between the outer surface of the internal member and the inner surface of the external member, wherein said gap exists throughout said relative movement.

3. A process for coating according to claim 1, in which the size of the gap between the member to be coated and the external member is substantially the same as that between the internal member and the external member when the internal member is in the hollow portion of the external member.

4. A process for coating according to claim 1, in which a coated film of not more than 200 microns in thickness when dried is formed on the member to be coated.

5. A process for coating according to claim 1, in which the coating material is retained in a gap formed between the internal member and the external member while the member to be coated is removed.

6. A process for coating according to claim 5, in which the distance between the top portion of the external member and the liquid surface level of the coating material is maintained substantially the same while the member to be coated is removed.

7. A process for coating according to claim 3, in which the internal member and the member to be coated are cylindrical and the external member is cylindrical and hollow.

8. A process for coating according to claim 7, in which the diameter of the member to be coated is substantially the same as that of the internal member.

9. A process for coating according to claim 7, in which the member to be coated is hollow.

10. A process for coating according to claim 1, in which the member to be coated is first placed on and fixed to the internal member while the internal member is in the hollow external portion and then the internal member is moved to bring the member to be coated to the hollow portion of the external member for contact with the coating material.

11. A process for coating according to claim 10, in which the internal member is first placed in the external member and the coating material is charged in the gap between the external member and the member to be coated.

* * * * *

UNITED STATES PATENT AND TRADEMARK OFFICE

CERTIFICATE OF CORRECTION

PATENT NO. : 4,328,267

DATED : May 4, 1982

INVENTOR(S) : TAKEHIKO MATSUO, ET AL.

It is certified that error appears in the above—identified patent and that said Letters Patent is hereby corrected as shown below:

Column 1, line 31, "It" should be --In--.

Column 3, line 22, "Z" should be --2--.

Column 5, line 16, "4" should be --14--.

Signed and Sealed this

*Twenty-ninth* Day of *June 1982*

[SEAL]

*Attest:*

GERALD J. MOSSINGHOFF

*Attesting Officer*

*Commissioner of Patents and Trademarks*